US005289677A

United States Patent [19]

Jarrell

[11] Patent Number: 5,289,677

[45] Date of Patent: Mar. 1, 1994

[54] COMBINED SUPPORT AND SEAL RING FOR A COMBUSTOR

[75] Inventor: David W. Jarrell, West Palm Beach, Fla.

[73] Assignee: United Technologies Corporation, Hartford, Conn.

[21] Appl. No.: 991,230

[22] Filed: Dec. 16, 1992

[51] Int. Cl.[5] ..... F02C 7/20

[52] U.S. Cl. ..... 60/39.31; 60/39.32; 60/752

[58] Field of Search ..... 60/39.31, 39.32, 39.36, 60/752

[56] References Cited

U.S. PATENT DOCUMENTS 4,785,623 11/1988 Reynolds ..... 60/39.36

*Primary Examiner*—Richard A. Bertsch
*Assistant Examiner*—W. J. Wicker
*Attorney, Agent, or Firm*—Norman Friedland

[57] ABSTRACT

A combined support and seal ring supports the aft end of an annular combustor and provides a seal to contact the leading edge of the platform of the adjacent stator vane for sealing the cooling air from the gas path in a gas turbine engine.

9 Claims, 3 Drawing Sheets

COMBINED SUPPORT AND SEAL RING FOR A COMBUSTOR

TECHNICAL FIELD

This invention relates to combustors for gas turbine engines and particularly to apparatus that supports and seals the liner of the combustor.

BACKGROUND ART

Annular combustors for gas turbine engines are typically supported at its aft end to the surrounding diffuser case and serves to inject combustion gases through the high pressure stator vanes to the turbine blades for powering the turbine rotor and generating thrust. Inasmuch as the area of concern of this invention is one of the most hostile environments encountered in the engine, consideration must not only been given to securing the structural integrity of the components, improving maintenance, and assuring that weight and costs are held to a minimum, it must also take into consideration the leakage problems. Since the combustor liner is encased in a surrounding diffuser case that defines with the liner a passageway for directing cooling air from the compressor to cool the combustor and components of the engine located downstream of the combustor, precautions must be made to prevent the leakage so that there will be sufficient air for cooling the other components located downstream therefrom.

This invention constitutes an improvement over U.S. Pat. No. 4,785,623 granted to H. G. Reynolds on Nov. 22, 1988 entitled "Combustor Seal and Support" and assigned to the assignee common to this patent application. This patent, supra, teaches a support that includes complementary lugs on the diffuser case and combustor liner that utilize the radial side surfaces of the lugs to frictionally engage each other to restrict upstream movement. A separate split ring seal is biased against a side edge of the platform of the adjacent high pressure stator vane to seal against leakage from the surrounding cool air passageway into the engine's gas path.

Obviously, since there is radial movement between the complementary surfaces of the lugs, it has been necessary to hard coat these surfaces in an attempt to increase the life of these component parts. Notwithstanding this process which adds significantly to the cost of the parts, these parts, at best, have a limited life span.

Additionally, because of the intimate relationship between the integral lugs on the combustor liner and the complementary integral lugs on the diffuser case it was necessary to hold the tolerances of these parts very closely. These tight tolerances, like the coating, contribute significantly to the cost to manufacture these parts. Another problem that exists in this configuration is the problem evidenced during installation. In assembly the stator vanes are installed after the combustor liners have been installed. Since the split ring and wave spring are loosely held in a U-shaped recess, there is a propensity for them to fall out. Hence, care must be taken when installing the stator vanes that contact is avoided since the insertion of the vanes could easily inadvertently knock out the split ring and wave spring from its operative position.

Other supports for combustors consisted of conical flanges bolted to the diffuser case. Because of the thermal mismatch between the combustor and the diffuser case owing to this environment, these parts evidenced severely high stresses. The large flange of this configuration blocked the flow of cooling air from reaching the high pressure turbine stator vane which necessitated large slots in the conical flange to pass the cooling air to these vanes. This not only adds to the cost of manufacture but also subjects the parts to acquiring fatigue cracks which tend to propagate and limit the part's life.

I have found that I can obviate the problems alluded to in the above by combining the support ring with the seal into a single part. Hence the material selected to fabricate this part doesn't require the hard coat that was necessary to obtain adequate wear resistance parts used in heretofore known designs. In my design the axial movement of the parts relative to each other is inherently restricted which not only simplifies the installation of the combustor but also provides a low stressed axial and radial support as well as damping of vibratory motions encountered.

DISCLOSURE OF INVENTION

An object of this invention is to provide improved means for supporting and sealing the combustor liner of a gas turbine engine.

A feature of this invention is to provide a combined seal and support for a combustor liner fabricated from a single unitary part which is characterized as being less expensive to fabricate and install, avoids the necessity of coating the part with a wear resistance coating, and provides low stress axial and radial support and vibratory damping.

The foregoing and other features of the present invention will become more apparent from the following description and accompanying drawings.

BEST MODE FOR CARRYING OUT THE INVENTION

While this invention describes in the preferred embodiment a combustor utilizing a Floatwall liner, it is to be understood that this invention, as one skilled in this art will appreciate, can be utilized with other types of combustors. Floatwall liners are well known in this art and are described in U.S. Pat. No. 4,302,941 granted to T. L. DuBell on Dec. 1, 1981 and entitled "Combustor Liner Construction for Gas Turbine Engine" and is incorporated herein by reference.

Figure 1:
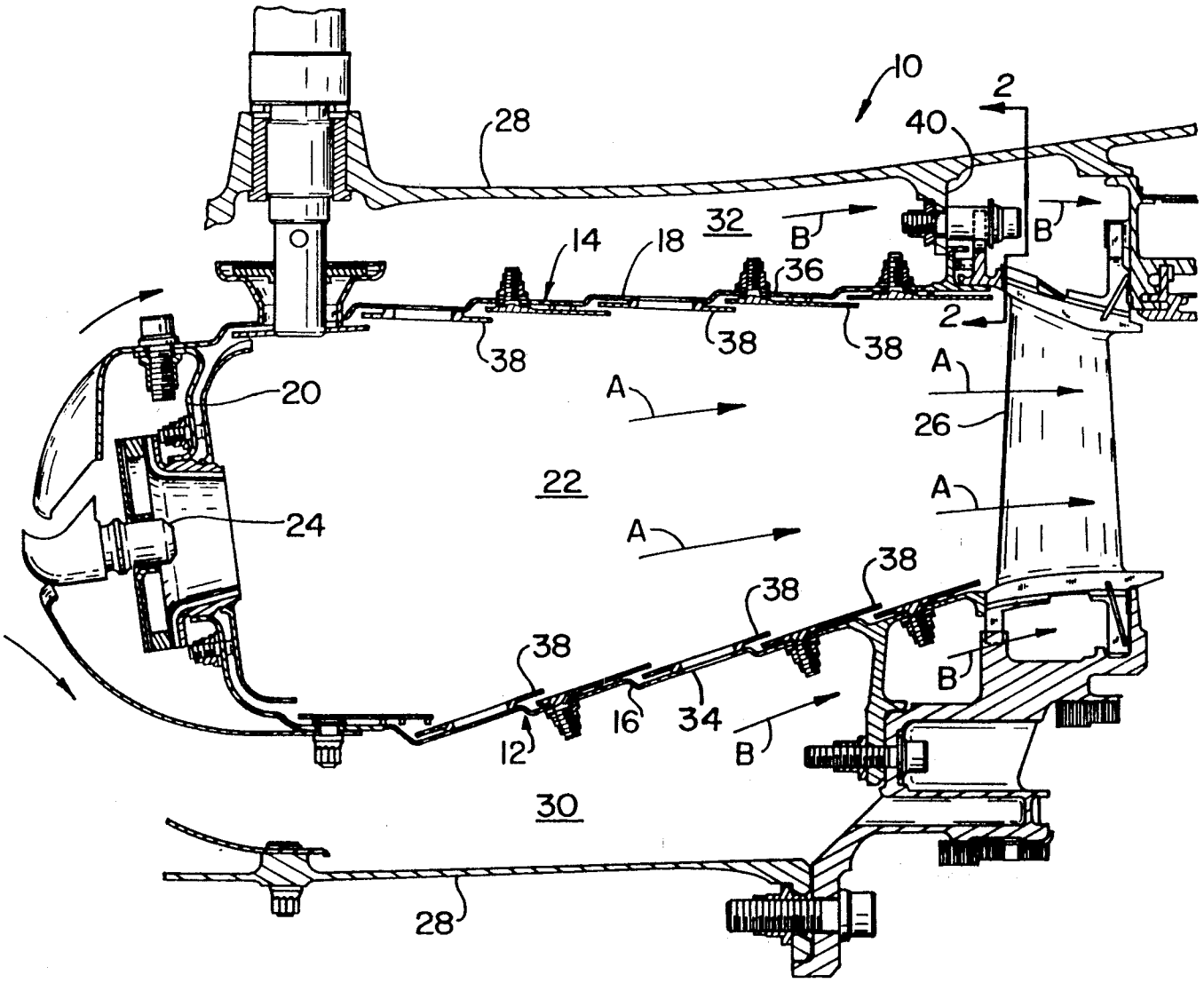
FIG. 1 is a partial view in section and elevation showing the combustor liner supported in the diffuser case and the adjoining high pressure stator vane for an axial flow gas turbine engine.

Suffice it to say and as best shown in FIG. 1, the combustor generally illustrated by reference numeral 10 is comprised of two generally concentrically mounted cylindrical or conically shaped elongated members 12 and 14 including an inner liner 16 and outer liner 18, respectively and joined at the forward end by the dome 20. Inner liner 16 and outer liner 18 together define an annular open ended combustion chamber 22. Fuel introduced to the combustion chamber 22 via a plurality of suitable fuel nozzles 24 (only one being shown) is burned in the combustion chamber 22 to generate the engines working medium for powering the turbines (not shown). These hot gases flowing through the open end flow through the stator inlet guide vanes 26 prior to being delivered to the turbine rotor mounted downstream of the combustor 10.

The diffuser case 28 is concentrically mounted relative to liners 16 and 18 and spaced therefrom to define together therewith and annular passages 30 and 32 that receive cooling air from the compressor (not shown}in a well known manner.

Liners 16 and 18 consists of an inner full hoop shell 34 and outer full shell 36 to which are attached a plurality of segmented plates 38. For more detail of this aspect of the liner configuration reference should be made to U.S. Pat. No. 4,302,941, supra. A portion of the cooling air in annular passages 30 and 32 passes through openings in the liner to cool the segmented plates 38, while the remaining portion passes along the inner and outer ends of stator vane 26 for cooling the downstream components of the engine. Obviously the amount of air used for cooling is precalculated and hence, it is abundantly important that leakage of this air is held to a minimum or the downstream components will not receive sufficient cooling air to maintain their structural integrity.

It is apparent from the foregoing that the liners 16 and 18 define the combustion chamber to generate the engine's working medium or engine's gas path represented by the arrows A and the liners 16 and 18 together with the diffuser case 28 define a portion of the cooling air flow path represented by arrows B.

Figure 2:
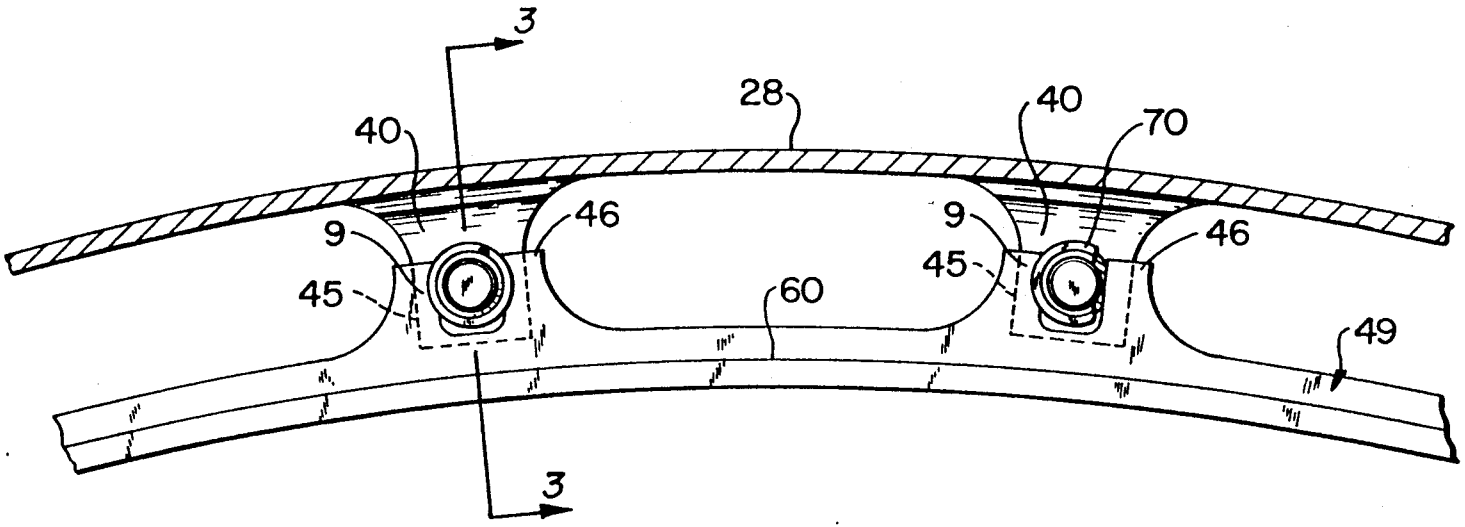
FIG. 2 is a partial end view illustrating the diffuser case lug and the combustor liner spline and the combined support and seal of this invention.
Figure 3:
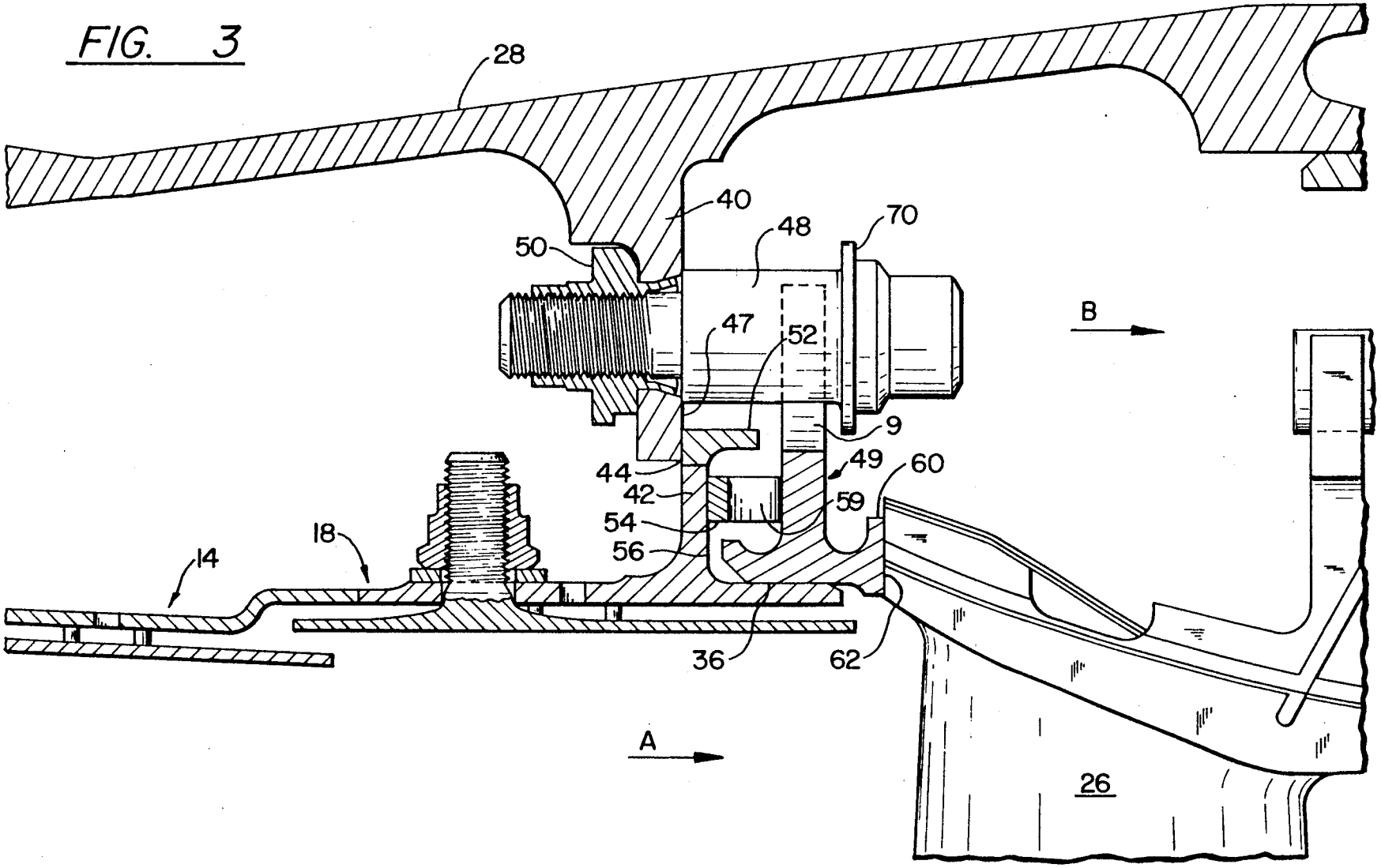
FIG. 3 is an enlarged view in section taken along lines 3—3 of FIG. 1 showing the details of this invention.

As can be seen in FIGS. 1-3 diffuser case 28 has circumferentially spaced around its inner diameter a plurality of radially inwardly extending lugs 40.

The shell 18 carries a radially outwardly extending annular flange 42 that has a plurality of spline members 9 having an upstream facing surface 44 that when installed bears against the downstream facing surface 47 of lugs 40.

The combined support and seal ring member 49 which is annular in shape and located adjacent the lugs 40 of diffuser case 28 carries a plurality of radially upward extending splines 9 that engages flanged bushings 48 between the space extending between the bifurcated arms 45 and 46 of spline 9. The flanged bushings 48 are bolted to the lug 40 of the diffuser case 28 by a suitable lock nut 50 threaded to the forward end of the flanged bushing 48. The flanged bushings are not load carrying members but serve to limit the axial, radial and circumferential movement of the combustor liner. The combined support and seal ring 49 is trapped by the flanged bushings but have limited movement in these directions to accommodate the thermals and vibratory motions encountered.

The rearwardly facing axially extending portion 52 of flange 42 and the outer diameter surface at the aft end of shell 18 define an annular recess adapted to support the wave spring washer 54 that has one surface bearing against the rearward facing surface 56 of flange 42 and the opposing end bearing against the forward facing surface 59 of combined support and seal ring member 49 to urge the seal portion 60 to contact the forward facing edge of platform 62 of the stator vane 26. This serves to prevent the leakage of the cooling air B from leaking into the gas path A.

According to this invention the combined support and seal member 49 is slidably mounted via the spline 9 in bushing 48 and the bottom surface engages the top surface of the aft end of shell 36 and the sealing portion 60 engages the platform 62 by virtue of being urged by wave washer 54. While the combined support and seal member 49 limits the axial movement by virtue of the flange 52 and the flange 70 on flange bushing 48 and radial movement by the flange bushing 48, it is apparent that virtually no load is imparted to these components while allowing the combustor liner to grow due to temperature and mechanical conditions, such as pressure loadings and the like. Because of the sliding relationship of the combined support and seal member 49 relative to the shell 36 and flanged bushing 48 there exists an inherent damping feature provided by this invention.

As mentioned above and according to this invention this configuration provides an improvement in the assembly of these component parts. In the heretofore configuration, unless due care was exercised, an inadvertent misalignment in assembling the stator vane in the engine that is stacked vertically, the seal and wave washer could be knocked out of place. In this configuration inadvertent knocking out of the seal and or wave washer can not occur. The fore and aft constraints occasioned by bolting the flanged bushing 48 trap the support and seal member 49 and even though the assembly is a blind one this arrangement assures that the support and seal member 49 is always in the proper position. Even if a surge condition occur, the annular flange 42 on the shell 36 will restrain the forward thrust of the support and seal member 49.

Although this invention has been shown and described with respect to detailed embodiments thereof, it will be appreciated and understood by those skilled in the art that various changes in form and detail thereof may be made without departing from the spirit and scope of the claimed invention.

What is claimed:

1. A combined support and seal ring for a combustor of a gas turbine engine having an annular line defining a combustion chamber, said liner including an outer shell member having an outwardly extending radial flange located adjacent a downstream end relative to the gases flowing in said combustion chamber, an annular diffuser case concentrically mounted relative to said annular liner having a plurality of circumferentially spaced inwardly radially extending lugs having a downstream facing surface engaging said flange, said combined support and seal ring having an inner diameter portion having a sealing surface and an outer diameter portion having a plurality of spline members, a bushing attached to said diffuser lug engaging and being in sliding relation with said spline members, a stator vane located downstream of said combustor having a platform with an annular sealing edge, and means for urging said sealing surface of said combined support and seal ring to be in contact with said annular sealing edge whereby said combined support and seal ring functions to support and seal said combustor.

2. A combined support and seal ring as claimed in claim 1 including a resilient member disposed between said flange and said combined support and seal ring axially urging said sealing surface in engagement with said annular sealing edge of said platform.

3. A combined support and seal ring as claimed in claim 2 wherein said resilient member includes a wave washer.

4. A combined support and seal ring as claimed in claim 3 wherein said flange includes an axially extending annular member at an outer periphery defining with said shell a recess for supporting said wave washer.

5. A combined support and seal ring as claimed in claim 4 wherein a downstream edge of said axially extending annular member limits the axial movement of said combined support and seal ring in one direction and a flange on one end of said bushing limits the axial movement of said combined support and seal ring in the opposite axial direction.

6. For an annular combustor of a gas turbine engine having a coaxially mounted stator vane supported adjacent a downstream end of said combustor, said stator vane including a platform having a complementary sealing surface, a diffuser case concentrically mounted and spaced relative to said annular combustor defining a passageway for leading cooling air, said diffuser case including a plurality of circumferentially spaced lugs, bushing means attached to said lugs, means for supporting said combustor and sealing the cooling air from the hot gases in said combustor, said supporting means including a combined support and seal ring in sliding relation to an annular shell defining a combustion chamber of said combustor, said combined support and seal ring including spline means on one diameter thereof and sealing means on an opposite diameter thereof engaging said bushings, a flange extending from said shell in abutting relation ship with said lugs, and axially biasing resilient means engaging said flange and said combined support and seal ring to place said sealing means in contact with said complementary sealing surface on the platform of said stator vane.

7. For an annular combustor as claimed in claim 6 wherein said resilient means is a wave washer.

8. For an annular combustor as claimed in claim 7 wherein said flange includes an axially extending annular member at its radially outer periphery defining with said shell a recess for supporting said wave washer.

9. For an annular combustor as claimed in claim 8 wherein a downstream edge of said axially extending annular member limits the axial movement of said combined support and seal ring in one direction and a flange on one end of said bushing limits the axial movement of said unitary support and seal ring in the opposite axial direction.

* * * * *